US008196362B1

(12) United States Patent
Ratts

(10) Patent No.: US 8,196,362 B1
(45) Date of Patent: Jun. 12, 2012

(54) APPARATUS FOR OPENING AND CLOSING A STORAGE BIN HATCH

(76) Inventor: Loyd Edmund Ratts, St. John, KS (US)

( * ) Notice: Subject to any disclaimer, the term of this patent is extended or adjusted under 35 U.S.C. 154(b) by 0 days.

(21) Appl. No.: 13/151,638

(22) Filed: Jun. 2, 2011

(51) Int. Cl.
*E05F 11/08* (2006.01)
*E05F 11/04* (2006.01)

(52) U.S. Cl. ..... 52/192; 49/357

(58) Field of Classification Search ..... 49/357; 52/192, 19; 251/294, 299
See application file for complete search history.

(56) References Cited

U.S. PATENT DOCUMENTS 3,733,750 A * 5/1973 Hege ..... 49/379
4,208,839 A 6/1980 Candy
4,267,936 A 5/1981 Pavlicek
4,327,522 A 5/1982 Meadows
4,598,496 A 7/1986 Van Daele
4,625,888 A 12/1986 Thompson
4,744,183 A 5/1988 Kruger
4,747,244 A 5/1988 Christianson
5,218,784 A 6/1993 Pollock
5,566,506 A 10/1996 Phillips
5,586,678 A * 12/1996 Rosch et al. ..... 220/263
5,839,597 A * 11/1998 Marttila ..... 220/264
7,392,804 B2 7/2008 Lockhart

* cited by examiner

*Primary Examiner* — Robert Canfield
*Assistant Examiner* — Brent W Herring

(57) ABSTRACT

Storage bin hatches typically have an opening surrounded by a rim and a cover having a flange that fits around the hatch opening rim. The apparatus, for opening and closing a storage bin hatch includes an elongated lift member fixed to a hatch cover and a pivot assembly. The pivot assembly is pivotably mounted to the storage bin roof adjacent to the storage bin hatch. The pivot assembly is moved by a first cable from the ground so that when the cable is pulled, the pivot assembly pivots and contacts the lift member and lifts the hatch cover to a raised position. By means of a second cable, an operator can pull the hatch cover to open the hatch. With a third cable, the operator can pull the hatch cover in the opposite direction to close the hatch.

8 Claims, 9 Drawing Sheets

APPARATUS FOR OPENING AND CLOSING A STORAGE BIN HATCH

FIELD OF THE INVENTION

This invention relates to an apparatus for remotely opening and closing a hatch cover of a storage bin.

BACKGROUND OF THE INVENTION

Storage bins are typically fashioned as cylindrical steel tanks and typically have a bottom, cylindrical sides and a roof. Although a typical storage bin used for storing grain may not be water tight or air tight, it is fashioned so that rodents and other pests cannot have access to stored grain. Generally, a storage bin has a rimmed cylindrical opening in the roof that is closed by a hatch cover that has a top plate and a flange having an inside diameter slightly larger than the outside diameter of the rim of the cylindrical opening. The hatch cover is removable, and, in order to gain access to the inside volume of the storage bin for the purpose of depositing or removing bulk materials such as grain, an operator must remove the hatch cover. In order to add or remove material from a storage bin, it is generally necessary for an operator to climb to the top of the bin and manually remove the hatch cover and then do so again to replace the hatch cover when the operation is completed. This operation requires time, effort and some risk. Accordingly, what is needed is an apparatus that makes it possible for an operator to remotely remove and replace a storage bin hatch cover without climbing to the top of the bin.

SUMMARY

The aforementioned need is addressed by an apparatus that allows an operator stationed on the ground adjacent to a storage bin to remove and replace a storage bin hatch cover from a storage bin opening located in the roof of the storage bin. In this example, the storage bin has side walls, a floor and a roof and a hatch in the roof. The storage bin roof has the shape of a flattened cone and the hatch is typically located at the apex of the cone. The hatch includes a hatch opening, a hatch opening rim encompassing the hatch opening and a hatch cover having a depending hatch cover flange that is adapted to fit around the rim of the hatch opening. The apparatus for opening and closing the hatch cover includes a lift member and a pivot assembly. The lift member is an elongated member that is secured tangentially on one side of the hatch cover flange and extends in both directions away from the hatch cover. The pivot assembly is mounted to the roof of the storage bin near the hatch and is operable for pivoting between a first position and a second position. The pivot assembly includes a pivot member, a crank arm and two opposite lift arms that extend away from the lift arm. The lift arms are arranged such that when the pivot assembly is in the first position, the lift arms are positioned under the opposite ends of the lift member such that when the pivot member is rotated toward the second position, the lift arms contact the lift member and raise the lift member and the hatch cover so that the flange of the hatch cover clears the flange around the hatch opening. It is preferable that the pivot assembly is biased toward the first position. A first cable which attached to the crank arm runs down to the ground so that an operator standing next to the bin may rotate the pivot assembly from the first position to the second position by pulling the first cable. At least one second cable pulley is mounted to the roof of the storage bin at a location that is spaced away from the hatch and opposite from the pivot assembly. A second cable is attached to the hatch cover at a location generally opposite the lift member. The second cable runs through the at least one second cable pulley and runs to a location near the end of the first cable. The operator, by pulling the second cable causes the hatch cover to slide between the raised position described above and a fully open position in which at least most of the storage bin hatch opening is exposed. A third cable is at least indirectly attached to the bin hatch cover at a location near the lift member. The third cable runs to a location proximate to the ends of the first and second cables. When the operator pulls the third cable, the hatch cover slides from the open position to the closed position.

An operator, in order to open the hatch, pulls the first cable to cause the hatch cover to be lifted sufficiently so that the hatch cover clears the hatch opening flange as described above. While the hatch cover is in the lifted position, as the operator continues to maintain tension on the first cable, the operator pulls the second cable to cause the hatch cover to slide to the open position. When the hatch cover is in the open position, the operator can release tension on the first and second cables. At this point, the hatch will be open and the pivot assembly will be in the first lowered position. To close the hatch, the operator pulls on the third cable until the hatch cover is reseated on the hatch opening.

DETAILED DESCRIPTION

Figure 1A:
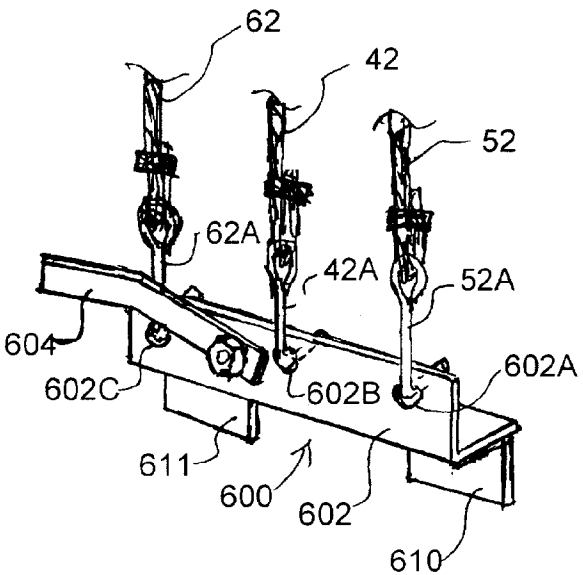
FIG. 1A is a perspective view the anchor assembly for anchoring the lower ends of the cables.
Figure 1:
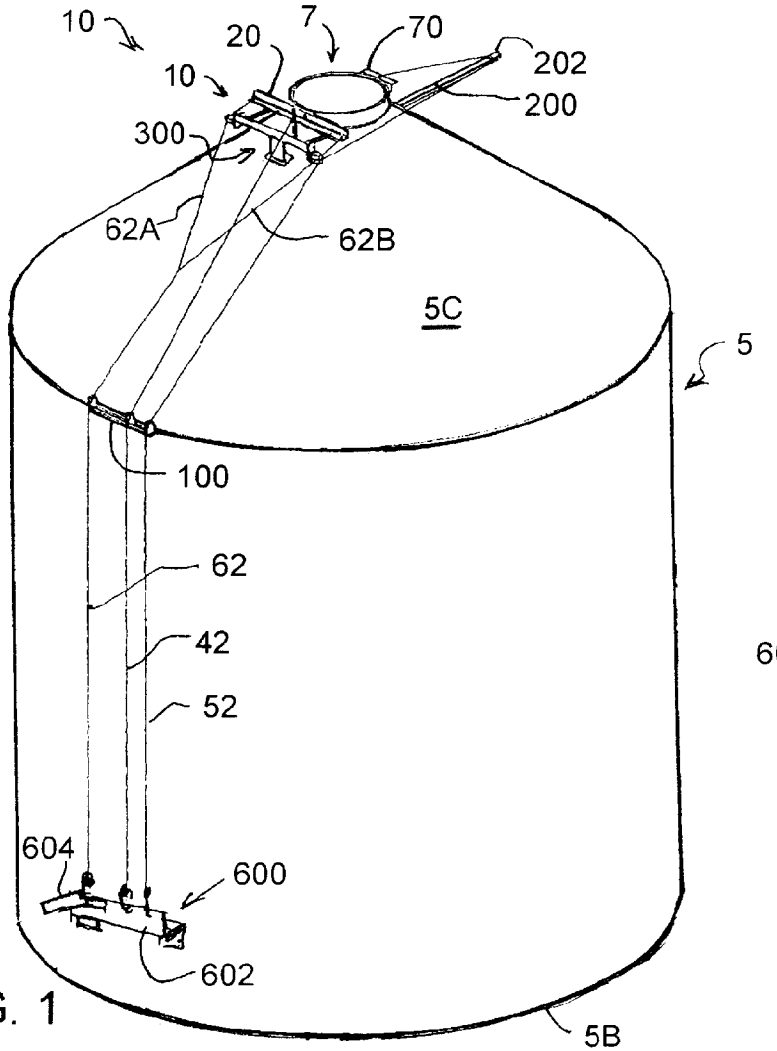
FIG. 1 is a perspective view of an apparatus for opening and closing a storage bin hatch shown installed on a storage bin.
Figures 3, 3A:
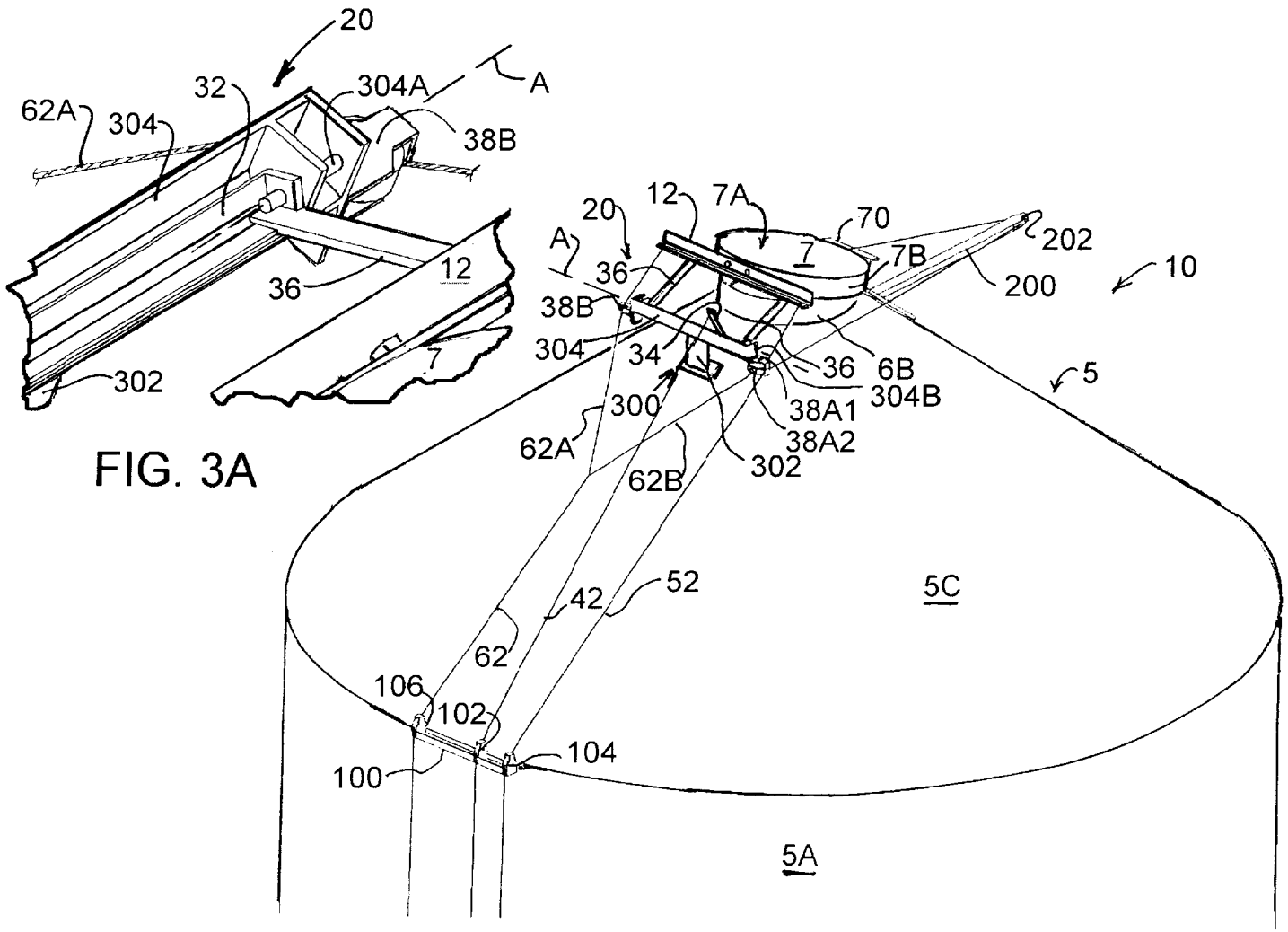
FIG. 3 is a perspective view showing the apparatus for opening and closing a storage bin hatch shown with the pivot assembly in a second position and the hatch cover in a raised position.
FIG. 3A is a magnified perspective view showing the pivot assembly in the second position and the hatch cover in a partially open position.
Figure 4:
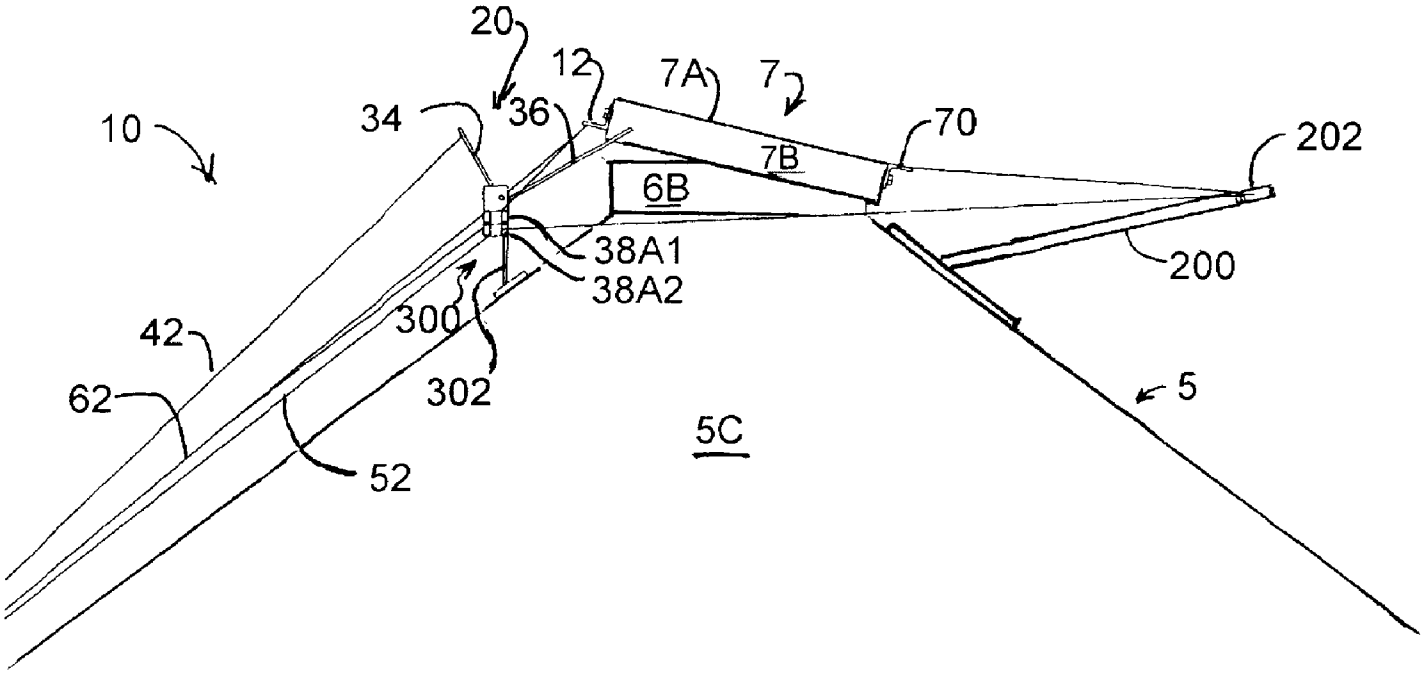
FIG. 4 is a side view showing the apparatus for opening and closing a storage bin hatch shown with the pivot assembly in the position shown in FIG. 3.
Figure 5:
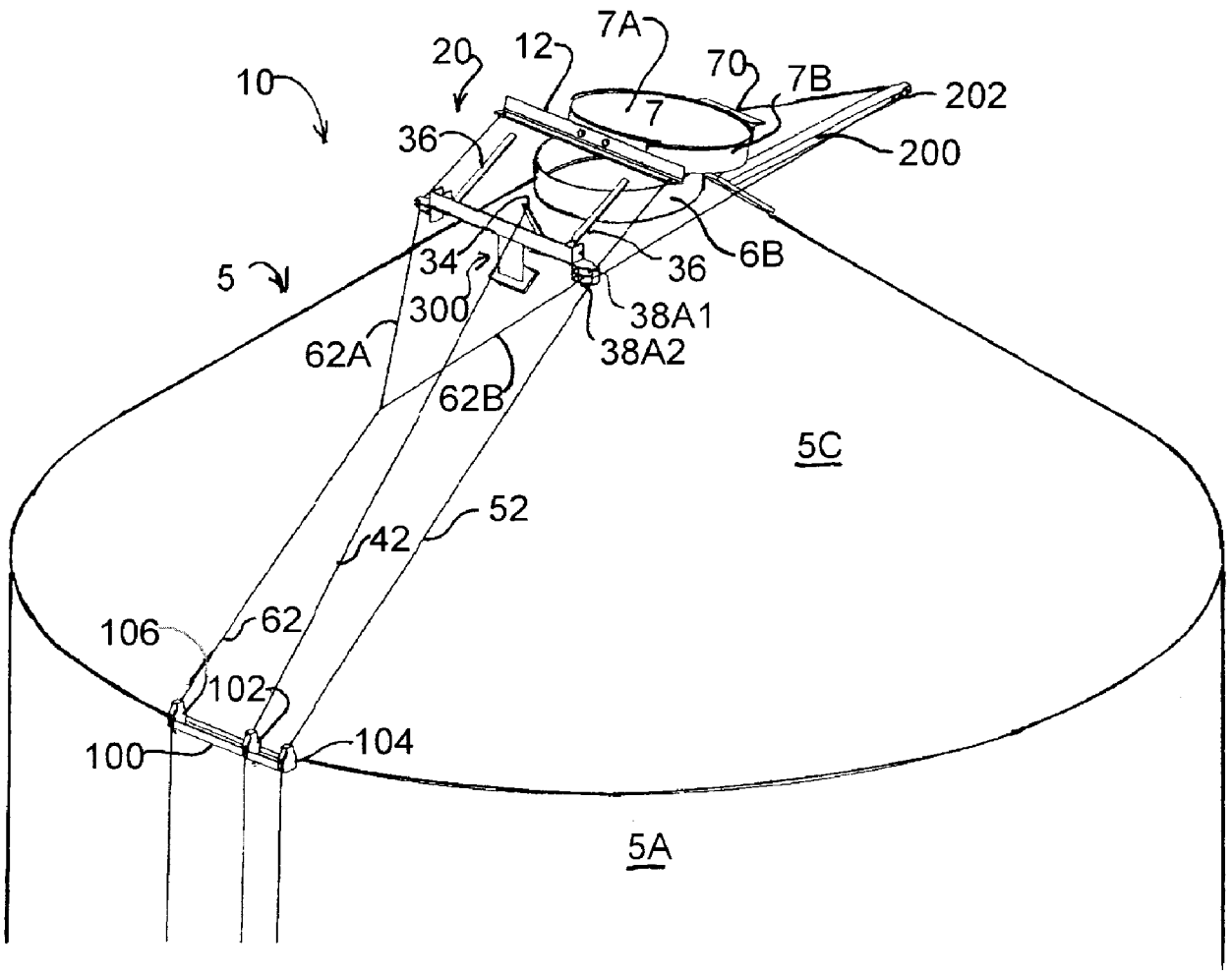
FIG. 5 is a perspective view showing the apparatus for opening and closing a storage bin hatch shown with the pivot assembly in the second position and the hatch cover in a partially open position.
Figure 6:
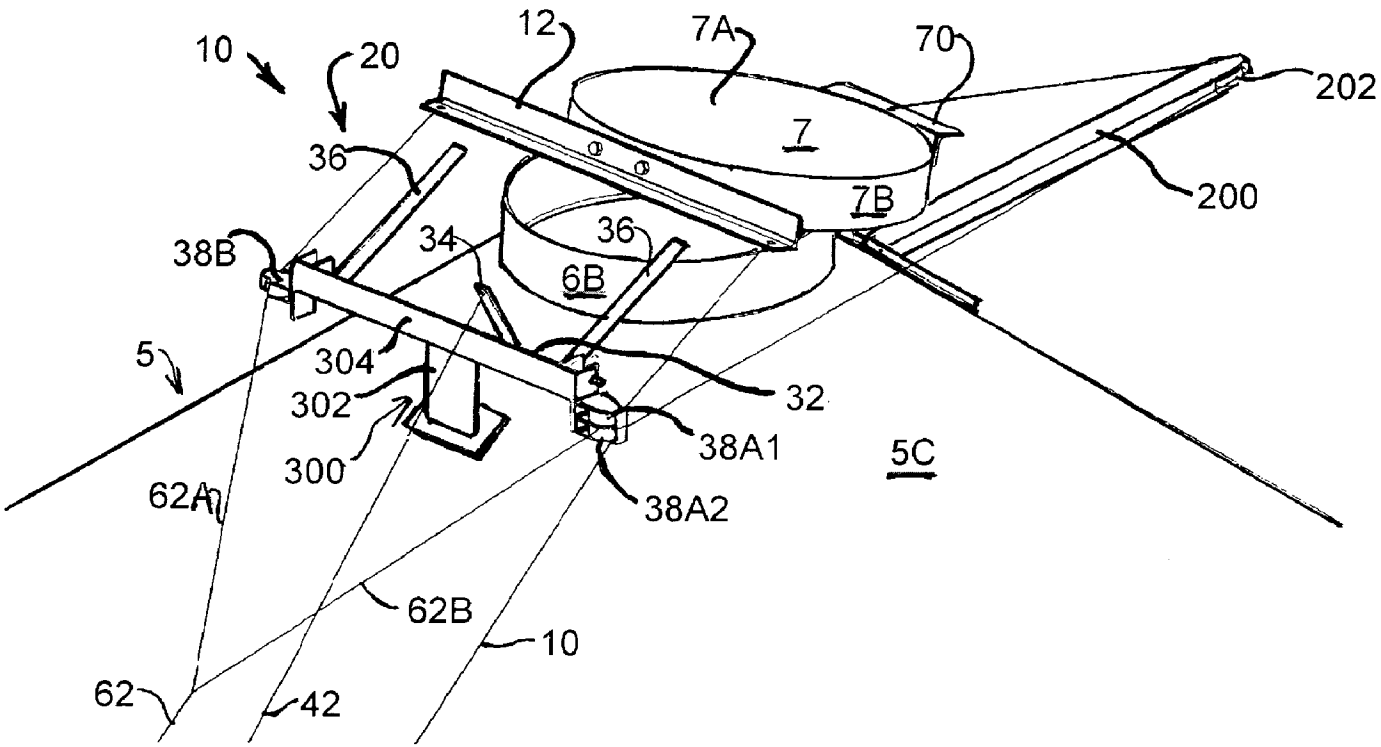
FIG. 6 is a magnified perspective view showing the apparatus for opening and closing a storage bin hatch shown with the pivot assembly in the second position and the hatch cover in the partially open position.

An apparatus 10 for opening and closing a storage bin hatch is shown in FIG. 1. In FIG. 1, an apparatus 10 for opening and closing a storage bin hatch is shown in relation to a hatch 6 which is situated on the roof 5C of a storage bin 5. Storage bin 5, in this example, further includes a side wall 5A and a floor 5B. Hatch 6 is located on roof 5C and, as can be best seen in FIG. 5, includes a generally circular hatch opening 6A and a rim 6B which has the form of a uniform normal cylindrical flange encompassing hatch opening 6A. As can be seen with reference to FIG. 2, hatch cover 7 includes a circular top plate 7A and a depending flange 7B which has the form of a uniform, normal cylindrical flange adapted for fitting around rim 6B of hatch 6. Apparatus 10 generally includes a lift member 12 and a pivot assembly 20. Lift member 12 is fixed to hatch cover 7. Pivot assembly 20 is operable for lifting lift member 12 and thereby tilting hatch cover 7 to a raised position shown in FIGS. 3 and 4. As will be explained in greater detail below, when cover 7 is in the raised position as shown in FIGS. 3 and 4 it can be slid to a fully open position shown in FIGS. 7 and 8. Apparatus 10 further includes first, second and third cables 42, 52, and 62 respectively for manipulating pivot assembly 20 and sliding hatch cover 7 between the tilted position and the fully open position and between the fully open position and the closed position.

Figure 2:
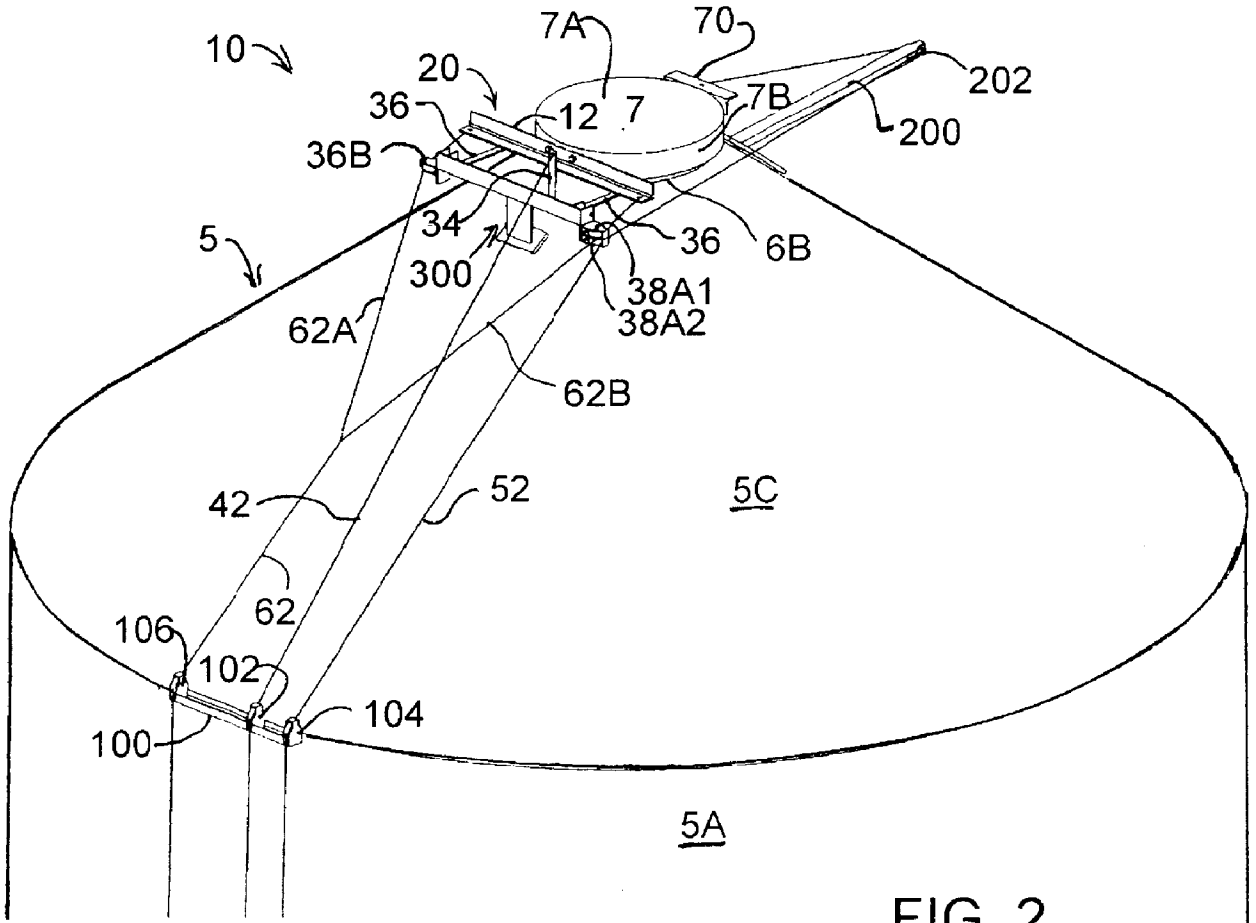
FIG. 2 is a perspective view showing the apparatus for opening and closing a storage bin hatch shown with a pivot assembly in a first position and a hatch cover in the closed position.

As can be best seen in FIG. 2, lift member 12, in this example, is fashioned from a rigid length of material and is fastened to flange 7B of hatch cover 7 so that it extends on either side of hatch cover 7. Pivot assembly 20 is mounted to roof 5C of storage bin 5. As can be best seen in FIG. 3A, pivot assembly 20 includes a pivot member 32 that is oriented generally parallel to lift member 12 and is secured to roof 5C. As can be best seen in FIGS. 3 and 3A, pivot member 32 is pivotably mounted to a bracket assembly 300 that, in turn is secured to roof 5C. As can be seen in FIG. 3, bracket assembly 300 includes a base 302 that is mounted to roof 5C and a transverse member 304. Connecting between the ends of transverse member 304 and the ends of pivot member 32 are two generally identical co-axial pivot rods 304A and 304B that are received by openings in the parallel double end walls of transverse member 304 and corresponding openings in the opposite ends of pivot member 32. Thus pivotably mounted, pivot member 32 can pivot about axis A indicated in FIGS. 3 and 3A between a first lowered position shown in FIG. 2 and a second raised position shown in FIG. 3. Those who are skilled in the art will appreciate that pivot member 32 may be mounted to roof 5C by means of any suitable structure that allows pivot member 32 to pivot about a transverse axis such as axis A that is generally parallel to lift member 12.

As can be seen in FIGS. 2-9, A crank arm 34 is fixed to pivot member 32 between the two opposite ends of pivot member 32 and is oriented so that it extends away from pivot member 32 in a generally normal direction. As can be best seen in FIGS. 3 and 3A, two lift arms 36 are fixed at each of the opposite ends of pivot member 32 and extend away from pivot member 32 so that they are generally normal to pivot member 32 and generally parallel to each other. In this example crank arm 34 and lift arms 36 are arranged so that there is generally a right angle between crank arm 36 and lift arms 36. The distal end of crank arm 34 receives the end of first cable 42. Lift arms 36 are oriented to pass under lift member 12 when pivot assembly 20 is in the first lowered position shown in FIG. 2. When an operator pulls on first cable 42, pivot assembly 20 pivots from a first lowered position shown in FIG. 2 to a second raised position shown in FIG. 3. When this occurs, lift arms 36 contact lift member 12, raise lift member 12 and thereby raise the end of hatch cover 7 to which lift member 12 is attached such that the lower edge of hatch cover flange 7A is above the upper edge of hatch rim 6B as shown in FIG. 3. When hatch cover 7 is in the raised position it is possible to slide hatch cover 7 from the raised position shown in FIG. 3 to a fully open position shown in FIG. 7 as will be described in greater detail below. It is preferable that pivot assembly 20 either be balanced or biased such that when tension is released from first cable 42, pivot assembly 20 returns to the first lowered position shown in FIGS. 1, 2, 8 and 9. The components of lift member 12 and pivot assembly 20 are preferably fashioned from durable tough steel pieces commonly referred to as "angle iron". The cables described herein may be conventional steel cables.

As can be seen in FIGS. 1 and 2, first cable 42 is attached to the distal end of crank arm 34 and runs through a first pulley 102 that is mounted to a first pulley bar 100. As can be best seen in FIGS. 1 and 1A, first cable 42 terminates with a first anchor pin 42A at a location that is accessible to an operator standing on the ground near bin 5. As can be seen in FIG. 2, pulley bar 100 is an elongated member fashioned from preferably extruded steel or angle iron and is mounted to the edge of roof 5C. Pulley bar 100 carries three pulleys, namely, first pulley 102 located between the ends of pulley bar 100 for redirecting first cable 42, a second pulley 104 located at the right end of pulley bar 100 for redirecting second cable 52 and a third pulley 106 located on the left end of pulley bar 100 for redirecting third cable 62. First, second and third pulleys 102, 104 and 106 may be of conventional design and may be conventionally mounted to pulley bar 100 in order to properly guide first, second and third cables 42, 52 and 62 respectively.

Figure 7:
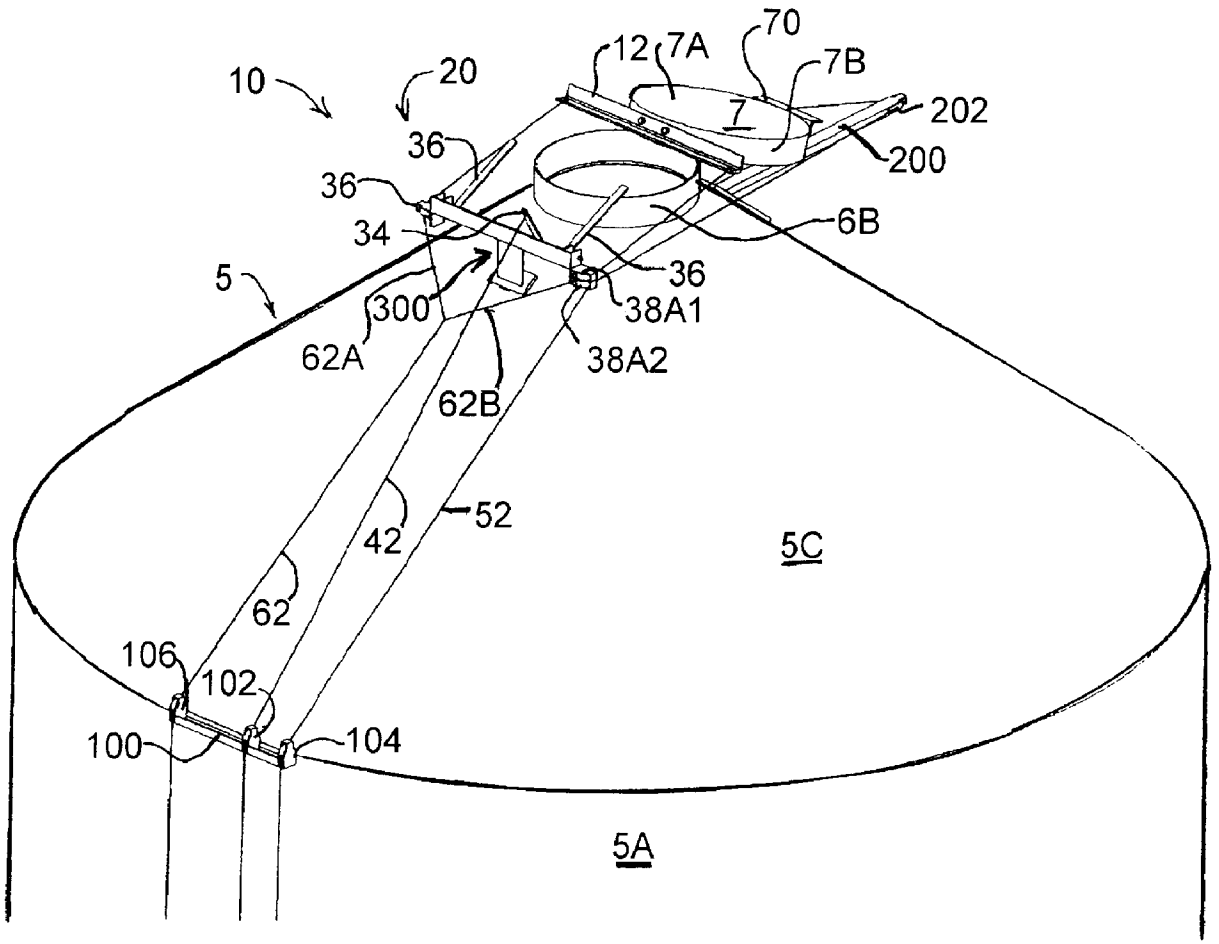
FIG. 7 is a perspective view showing the apparatus for opening and closing a storage bin hatch shown with the pivot assembly in the second position and the hatch cover in a fully open position.

Other components of apparatus 10 provide a means for an operator to slide hatch cover 7 from the raised position shown in FIG. 3 to a fully open position shown in FIG. 7. As can be seen in FIG. 2, second cable 52 passes through second pulley 104 mounted to pulley bar 100. From second pulley 104, second cable 52 passes through pulley 38A2 mounted to the right end of transverse member 304 of bracket assembly 300, then passes through a pulley 202 mounted at the distal end of a pulley mast 200. Pulley mast 200, is, in turn, is fixed to roof 5C of bin 5. Pulley mast 200 is preferably fashioned from a steel channel ("angle iron") and is mounted at a location that is opposite from pivot assembly 20 in relation to hatch 6. Pulley mast 200 is preferably elongated as shown in FIG. 2 and supports a pulley 202 at a location that is spaced away from the downward sloping surface of roof 5C. After passing through pulley 202, second cable 52 is aligned with the center of hatch cover 7 so that hatch cover 7 can be pulled in a direction that is generally normal to pivot assembly 20. Accordingly, second cable 52 is connected to a bracket 70 which is fixed to hatch cover 7 at a location that is opposite from lift member 12. When the end of second cable 52 is pulled by an operator, and if hatch cover 7 is in the lifted position shown in FIGS. 3 and 4, hatch cover 7 will first slide to the partially open position shown in FIGS. 5 and 6 and then to the fully open position shown in FIGS. 7 and 8.

Figure 8:
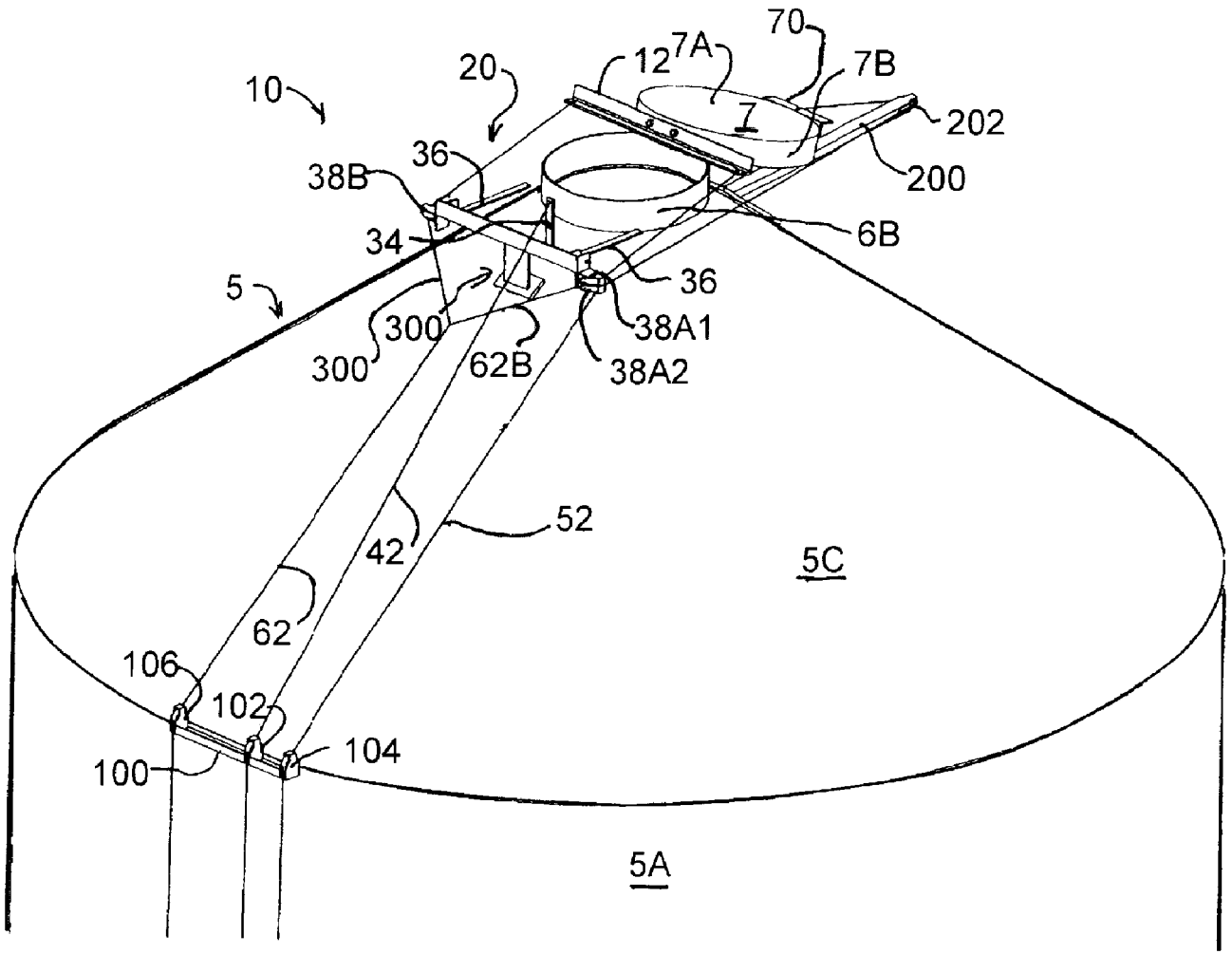
FIG. 8 is a perspective view showing the apparatus for opening and closing a storage bin hatch shown with the pivot assembly in the first position and the hatch cover in the fully open position.
Figure 9:
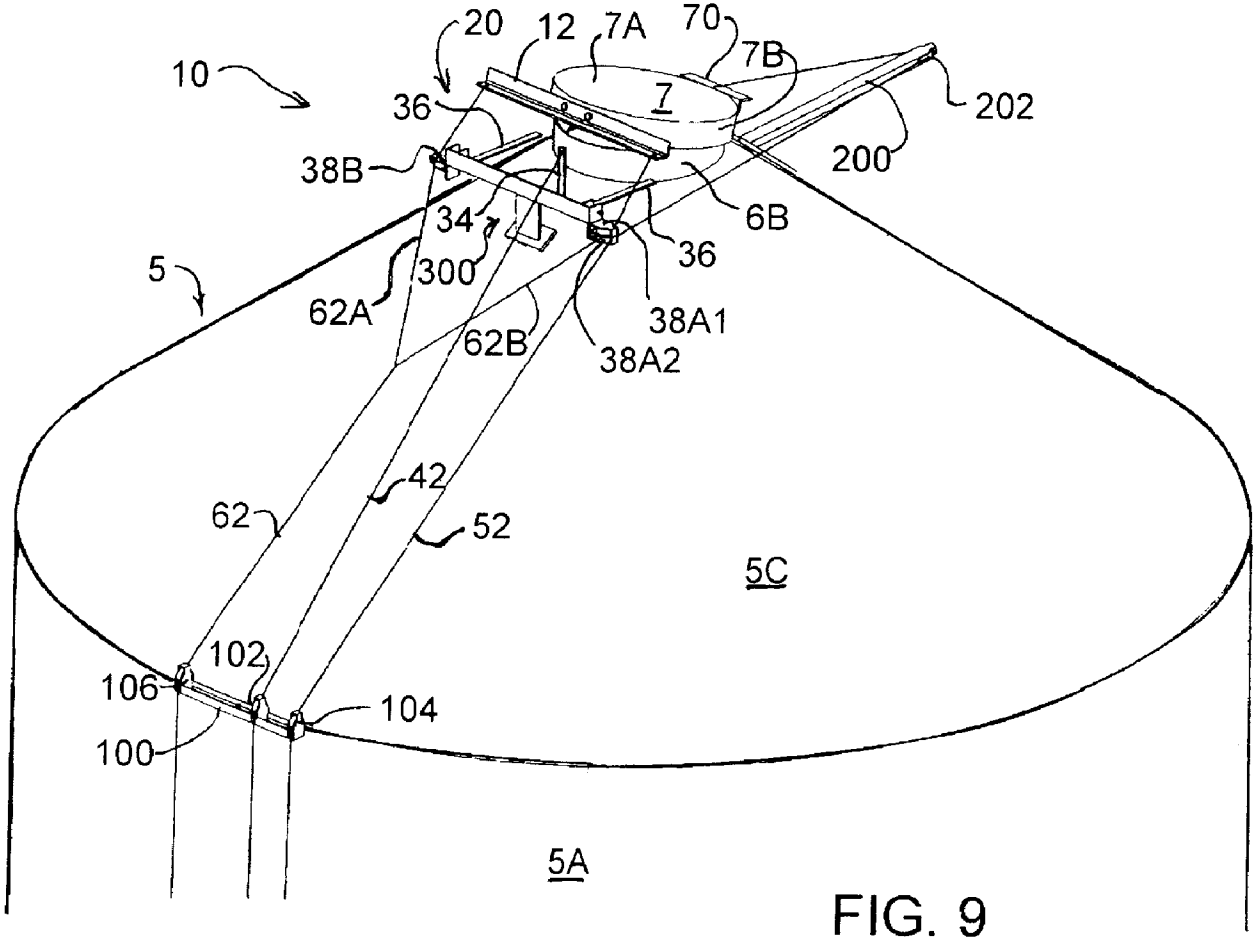
FIG. 9 is a perspective view showing the apparatus for opening and closing a storage bin hatch shown with the pivot assembly in the first lowered position and the hatch cover having been slid back to the partially open position.

Still other components of apparatus 10 make it possible for an operator to slide hatch cover 7 from the fully open position shown in FIG. 7 back to the closed position shown in FIG. 2. In order to pull hatch cover 7 back to the closed position, it must be possible to pull on hatch cover 7 from a direction opposite bracket 70 and pull hatch cover 7 in a direction that is generally normal to pivot assembly 20. This is accomplished by third cable 62 that divides into first and second cable branches 62A and 62B. Third cable 62 is directed to an anchor pin 62A by third pulley 106 as noted above. Cable branches 62A and 62B pass through two opposite pulleys 38A1 and 38B fixed to opposite ends of pivot transverse member 304 of bracket assembly 300. After passing through pulleys 38A1 and 38B, cable branches 62A and 62B attach to the respective opposite ends of lift member 12. This configuration insures that when an operator pulls on third cable 62, cable branches 62A and 62B pull on lift member 12 from widely spaced locations. By pulling on the opposite ends of lift member 12 from spaced locations, hatch cover 7 is pulled directly over hatch opening 6A and reseats over hatch opening 6A as shown in FIG. 2. For an operator to return hatch cover 7 to the closed position from the fully open position shown in FIG. 7, the operator must first release tension on first cable 42. Because pivot assembly 20 is biased in the first lowered position as noted above, when first cable 42 is released, pivot assembly 20 returns to the first lowered position as shown in FIG. 8. With lift members 36 laying down at least close to roof 5C of bin 5 as shown in FIG. 8, it is possible to slide hatch cover 7 across hatch opening 6. The operator by pulling third cable 62 is able to slide hatch cover 7 until it reseats on hatch opening 6 as shown in FIG. 2.

It is important that first cable 42, second cable 52 and third cable 62 be anchored at their lower ends when not in use as shown in FIG. 1A. In particular, when first cable 42 and second cable 52 are anchored as shown in FIG. 1A, hatch cover 7 is also secured in the closed position as shown in FIG. 1. As can be seen in FIGS. 1 and 1A, each of first, second and third cables 42, 52 and 62 have anchor pins 42A, 52A and 62A respectively fastened at the lower ends of each respective cable. Fixed to the side wall 5A of storage bin 5 is an anchor bracket assembly 600 which includes a transverse bracket member 602 that presents a generally upright flange. Bracket member 602 is mounted to side wall 5A of storage bin 5, in this example, by brackets 610 and 611. Each anchor pin has a curved lower portion that is adapted to be received by corresponding openings 602A, 602B and 602C in the upright flange of bracket member 602. To further secure anchor pin 62A associated with third cable 62, a resilient pivoting anchor clip 604 is pivoted over the portion of anchor pin 62A that lays against the upright flange of bracket member 602. This secures pin 62A in opening 602C, thereby insuring that hatch cover 7 is not inadvertently removed from the hatch opening. The purpose of storage bin 5 is to protect the contents of the storage bin from the intrusion of moisture. Accordingly, it is of paramount concern that hatch 7 remains closed when the apparatus 10 is not in use.

The steps for opening and closing a storage bin hatch using apparatus 10 are as follows. An operator, in order to open hatch cover 7, first rotates anchor clip 604 away from end pin 62A and then removes end pin 62A from opening 602C. With third cable 62 unanchored, it is possible to open and slide hatch 7 toward the open position. This is accomplished by first pulling on first cable 42 which causes pivot member 32 to rotate so that lift arms 36 contact and raise lift member 12 thereby lifting the lower end of hatch cover 7 up to clear the cylindrical flange 6B encompassing hatch opening 6A. With hatch cover 7 raised in the lifted position shown in FIG. 3, it is possible to slide hatch cover 7 toward the open position shown in FIG. 7. The sliding of hatch cover 7 toward the open position shown in FIG. 7 is accomplished by pulling on second cable 52 while continuing to maintain tension on first cable 42. After hatch cover 7 is at least partially open as shown in FIG. 3, the operator may release tension on first cable 42 which allows pivot assembly 20 to return to the first lowered position as shown in FIG. 8. Once hatch cover 7 is in the partially open position shown in FIG. 3, the operator may slide hatch cover 7 to the fully open position shown in FIG. 7 by continuing to pull on second cable 52. Before returning hatch cover 7 to the closed position, the operator must first be sure that tension is not applied to first cable 42 so that lift arms 36 will not be raised and thus interfere with lift member 12 as hatch cover 7 slides toward the closed position. To return hatch cover 7 to the closed position, the operator pulls on third cable 62 until hatch cover 7 is reseated on cylindrical flange 6B encompassing hatch opening 6. Once hatch cover 7 is reseated on cylindrical flange 6B encompassing hatch opening 6, the operator preferably anchors third cable 62 by inserting its anchor pin 62A in opening 602C and rotating clip 604 to the locked position as shown in FIG. 1A. This secures hatch cover 7 in the closed position shown in FIG. 1.

From the above description, the skilled reader can appreciate that apparatus 10 provides a means for remotely opening and closing a storage bin hatch. An operator standing next to bin 5 may raise and open a hatch cover and replace a hatch cover to a closed position without leaving his or her position on the ground next to bin 5.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. An apparatus for remotely opening and closing a storage bin hatch cover, comprising:

(a) a storage bin having side walls, a floor and a roof, a hatch in the roof, the hatch including a hatch opening, a hatch opening rim disposed around the hatch opening and a hatch cover having a depending hatch cover flange that is adapted to fit around the hatch opening rim, (c) a lift member secured to the hatch cover and extending on opposite sides of the hatch cover, (d) a pivot assembly including an elongated pivot member that is pivotably mounted at least indirectly to the roof of the storage bin at a location that is spaced away from the hatch, the pivot member operable for pivoting between a first position and a second position, a crank arm fixed to the pivot member and two opposite lift arms fixed to the pivot member toward the opposite ends thereof, the pivot assembly and the lift arms arranged such that when the pivot member is in the first position, the lift arms are positioned under the opposite ends of the lift member such that when the pivot member is rotated toward the second position, the lift arms contact the lift member and raise the lift member and the storage bin hatch cover such that the lower edge of the hatch cover flange adjacent to the pivot assembly is raised above the upper edge of the rim surrounding the hatch opening, a first cable attached to the crank arm, the crank arm so arranged and the first cable extending sufficiently to be accessible to an operator standing near the floor of the bin so that the operator may rotate the pivot member from the first position to the second position by pulling the first cable thereby causing the storage bin hatch cover to be lifted from the closed position to the raised position, (e) at least one rear pulley mounted to the roof of the storage bin at a location that is spaced away from the hatch and opposite from the pivot assembly, (f) a second cable attached to the hatch cover at a location generally opposite the lift member, the second cable running through the at least one rear pulley and running to a location proximate to the end of the first cable so as to also be accessible by the operator so that the operator may pull on the second cable to cause sliding movement of the hatch cover from the raised position and an open position wherein at least a portion of the storage bin hatch opening is exposed, (g) a third cable at least indirectly attached to the bin hatch cover at a location generally opposite the attachment location of the second cable, the third cable running to a location proximate to the ends of the first and second cables so as to be accessible by the operator so that the operator may pull the third cable to cause sliding movement of the hatch cover from the open position to the closed position.

2. The apparatus of claim 1, further comprising:

a first pulley bar having first, second and third pulleys for directing the first, second and third cables respectively toward the floor of the bin for access by an operator.

3. The apparatus of claim 1, further comprising:

a first pulley bar having first, second and third pulleys for directing the first, second and third cables respectively toward the floor of the bin for access by an operator, and, a pulley mast for mounting at least one pulley wherein the pulley mast is fixed to the roof of the bin at a location that is spaced away from the hatch and opposite from the pivot assembly, the pulley of the pulley mast positioned for redirecting the second cable from the second pulley of the first pulley bar to the attachment location of the second cable on the hatch cover.

4. The apparatus of claim 1, wherein:

the pivot assembly is biased in the first lowered position.

5. The apparatus of claim 1, wherein:

at least one of the cables is anchored at its lower end at least indirectly to the wall of the bin to prevent the unintended opening of the hatch.

6. The apparatus of claim 1, wherein:

at least one of the cables is anchored at its lower end at least indirectly to the wall of the bin to prevent the unintended opening of the hatch.

7. The apparatus of claim 1, wherein:

each of the cables is anchored at its lower end at least indirectly to the wall of the bin to prevent the unintended opening of the hatch.

8. The apparatus of claim 1, wherein:

the third cable branches into a first branch and a second branch, the first branch running through a first pulley disposed at a first end of the pivot member of the pivot assembly and the second branch running through a second pulley disposed at a second end of the pivot member of the pivot assembly opposite from the first end, the first branch connected to one end of the lift member and the second branch connected to the opposite end of the lift member, whereby when the third cable is pulled by an operator, the first and second branches pull symmetrically on the opposite ends of the lift member thereby causing the hatch cover to be pulled straight over the hatch opening to facilitating reseating of the hatch cover on the hatch opening.

* * * * *